US008226437B2

(12) United States Patent
Quiter et al.

(10) Patent No.: US 8,226,437 B2
(45) Date of Patent: Jul. 24, 2012

(54) CONNECTOR SYSTEM, USE AND METHOD

(75) Inventors: Michael Quiter, Ebersberg (DE); Sven Braun, Munich (DE)

(73) Assignees: Yamaichi Electronics Co., Ltd., Tokyo (JP); Yamaichi Electronics Deutschland GmbH, Munich (DE)

( * ) Notice: Subject to any disclaimer, the term of this patent is extended or adjusted under 35 U.S.C. 154(b) by 0 days.

(21) Appl. No.: 12/991,874

(22) PCT Filed: May 11, 2009

(86) PCT No.: PCT/EP2009/003330

§ 371 (c)(1),
(2), (4) Date: Dec. 23, 2010

(87) PCT Pub. No.: WO2009/135692

PCT Pub. Date: Nov. 12, 2009

(65) Prior Publication Data

US 2011/0104925 A1 May 5, 2011

(30) Foreign Application Priority Data

May 9, 2008 (DE) ..... 10 2008 022 909
Oct. 1, 2008 (DE) ..... 10 2008 050 155

(51) Int. Cl.
*H01R 13/58* (2006.01)

(52) U.S. Cl. ..... 439/604

(58) Field of Classification Search ..... 439/604, 439/353, 271, 447

See application file for complete search history.

(56) References Cited

U.S. PATENT DOCUMENTS

| | | | | |
|---|---|---|---|---|
| 7,275,949 | B1 * | 10/2007 | Speaker, IV et al. | 439/271 |
| 7,510,433 | B2 | 3/2009 | Blakborb | |
| 2004/0161970 | A1 | 8/2004 | Wlos et al. | |
| 2005/0233639 | A1 | 10/2005 | Blosch et al. | |

FOREIGN PATENT DOCUMENTS

| | | | |
|---|---|---|---|
| DE | 202004015365 | U1 | 12/2004 |
| EP | 1424361 | A | 6/2004 |
| JP | 2003-317866 | A | 11/2003 |
| JP | 2003-346970 | A | 12/2003 |
| JP | 2008-311196 | A | 12/2008 |
| WO | 2004/034516 | A | 4/2004 |

OTHER PUBLICATIONS

International Search Report dated Aug. 25, 2009 in corresponding International Patent Application No. PCT/EP2009/003330, 3 pages.

* cited by examiner

*Primary Examiner* — Phuong Dinh
(74) *Attorney, Agent, or Firm* — Maier & Maier, PLLC

(57) ABSTRACT

A connector system with a connector and a complementary connector, wherein the connector includes a housing element with a locking device and an electrical contact element, wherein the electrical contact element is arranged in the area of a front end of the housing element, and includes a closing element arranged on the housing element, which closing element surrounds both at least the rear end of the housing element and an area of the electrical cable arranged outside the housing element, and is closely connected with the housing element and the electrical cable such that at the rear end, the interior of the housing element is sealed from the surrounding in a substantially fully moisture-tight manner. The closing element may, optionally, be applied in a substantially liquid form.

14 Claims, 3 Drawing Sheets

CONNECTOR SYSTEM, USE AND METHOD

RELATED APPLICATIONS

This application is the U.S. national stage application which claims priority under 35 U.S.C. §371 to International Patent Application No.: PCT/EP2009/003330, filed on May 11, 2009, which claims priority under 35 U.S.C. §119, to German Patent Application No.: 10 2008 022 909.1 filed on May 9, 2008, and to German Patent Application No. 10 2008 050 155.7, filed on Oct. 1, 2008, the disclosures of which are incorporated by reference herein in their entirety.

The present invention relates to a connector system and to a use of connectors for providing the connector system, as well as to the use of the connector system for connecting a photovoltaic or solar module to an energy pick-up, and to a method.

Conventionally, solar modules are arranged on roofs of houses or on specially provided surface-near holding constructions, for example. The energy generated by the solar modules is fed from the solar modules to one or more electrical energy pick-ups by means of electrical cables. In doing so, it must be ensured that the connection between a current output of a solar module and a current input of the electrical energy pick-up is reliable and save with all weather conditions.

It is therefore an object of the present invention to allow for a reliable and secure connection of e.g. a solar module with an energy pick-up. This object is solved by the subject matters of the independent claims. Preferred embodiments are subject of the dependent claims.

Connector System According to One Aspect

One aspect of the present invention relates to a connector system with a connector and a complementary connector, wherein the connector comprises a housing element with at least one locking device and at least one electrical contact element, wherein the at least one electrical contact element is arranged in the area of a front end of the housing element, comprises an electrical cable, wherein a cable end area of the electrical cable is arranged in the area of a rear end of the housing element, and at least one conductor of the electrical cable is connected with the electrical contact element, and the cable extends toward the other cable end area through the rear end of the housing element out of the housing element, and comprises a closing element arranged on the housing element, which closing element surrounds or circumferences both at least the rear end of the housing element and an area of the electrical cable arranged outside the housing element, and is closely connected with the housing element and the electrical cable such that at the rear end, the interior of the housing element is sealed or closed from the surrounding in a substantially fully moisture-tight manner, the complementary connector comprises a complementary housing element with at least one complementary locking device and at least one complementary electrical contact element, wherein the at least one complementary electrical contact element is arranged in the area of a front end of the complementary housing element, comprises an electrical cable, wherein a cable end area of the electrical cable is arranged in the area of a rear end of the complementary housing element, and at least one conductor of the electrical cable is connected with the complementary electrical contact element, and the cable extends toward the other cable end area through the rear end of the complementary housing element out of the complementary housing element, and comprises a closing element arranged on the complementary housing element, which closing element surrounds both at least the rear end of the complementary housing element and an area of the electrical cable arranged outside the complementary housing element, and is closely connected with the complementary housing element and the electrical cable such that at the rear end, the interior of the complementary housing element is sealed or closed from the surrounding in a substantially fully moisture-tight manner, wherein the housing element has a receiving device at a front end, which is designed to receive an insertion device of the complementary connector arranged at the front end of the complementary connector at least in some area(s) along an insertion direction, and wherein the locking device and the complementary locking device are designed such that the at least one complementary locking device is at least in some area(s) insertable into the locking device along the insertion direction and can be locked with the locking device such that the locking device and the complementary locking device can be unlocked by actuation of the locking device and/or the complementary locking device substantially exclusively by means of a tool, and to connect the insertion device of the complementary connector with the receiving device of the connector such that the electrical contact element is sealed from the surrounding in a substantially moisture-tight manner at the front end of the connector and the complementary electrical contact element is sealed from the surrounding in a substantially moisture-tight manner at the front end of the complementary connector.

The electrical contact element and/or the complementary electrical contact element may also extend toward the area of the rear end of the housing element.

Advantageously, by the possible locking of the connector with the complementary connector, in conjunction with the close connection of the closing element with the connector and the cable (or of the corresponding closing element with the complementary connector), it is ensured that the connector system is reliably and safely connectacle and that in particular no leakage currents can flow from the interior of the locking connector system to the outside, i.e. to the surrounding, due to entering moisture. In particular, the combination of the simple and reliable locking, which can be unlocked substantially exclusively by means of a tool, and the close connection of the respective closing element with the housing element of the connector and the cable of the connector or the complementary connector allows for a water tightness according to the industrial standard IP 67, in particular IP 68, with at the same time a very small construction height, and also a given flame resistance according to norm UL 94 with the classification V-0. The term "moisture-tight" as used in this application thus describes in particular that the locked connector system passes in particular a moisture test according to IP 67, particularly preferably IP 68.

Furthermore, by the close connection of the housing element with the closing element and the cable with the closing element, a sealing of the rear end from moisture, in particular from entering water or water vapor and/or other liquids is achieved, wherein a very simple construction is realized, and a number of sealing means can in particular be dispensed with.

In particular in this connection, the term "moisture-tight" as defined by the present application describes a tightness or a barrier against a fluid, in particular water and/or water vapor. Moisture tightness is obtained if the migration, i.e. the flow or displacement of moisture due to a partial pressure difference or the pressure difference (in particular in the case of a pressure difference of approx. 10 kPa) or the diffusion, is prevented or sufficiently slowed down. Sufficiently slow in particular means that the flow rate of the fluid in a body within pores or along channel-shaped or flat preferential flow paths does preferably not exceed a value of approx. 1 m per hour, of approx. 1 cm per hour, of approx. 1 mm per day, further preferably approx. 1 mm per year, particularly preferably 0.1 mm per year, in particular 0.01 mm per year.

Moreover, this simple construction allows for a very compact construction of the connector and the complementary connector and thus also of the connector system, so that the connector system can e.g. be inserted between a solar module and a holder of the solar module. Thereby as well, the connector system can be protected further and in particular function reliably.

In other words, an entrance of moisture into the interior of the connector system, in particular to the electrical contact elements, from the front ends of the connector/complementary connector is reliably prevented by the locking. An entrance of moisture into the interior of the connector system, in particular to the electrical contact elements, from the front ends of the connector/complementary connector is reliably prevented by the closing elements. In combination, it is thus achieved that the connector system has a high moisture tightness, in particular according to IP 67, particularly preferably IP 68, with at the same time a very compact construction size.

The housing element may be a substantially rigid housing element, i.e. the housing element comprises a material, in particular a thermoplastic material or a polymer or is made of a thermoplastic material or a polymer, which has such a torsional and/or tensile stiffness that the connector and the complementary connector resist usual forces during mutual connection and locking and in particular allow for a secure and reliable locking, wherein the material is also flexible enough so that the locking device and the complementary locking device are displaceable, in particular bendable and/or compressible, for locking and/or unlocking, and this also for a plurality of locking and/or unlocking operations. Moreover, the material is stiff or firm enough so that the unlocking is possible not exclusively manually, i.e. without a tool. In other words, it is substantially not possible in the operative use to unlock the connector from the complementary connector without a tool. However, the connector and the complementary connector can be locked exclusively manually, i.e. without a tool, in a simple manner. If the connector is unlocked exclusively manually, i.e. without a tool, the locking device and the complementary locking device are preferably formed such or locked with each other that the locking device and/or the complementary locking device are damaged, in particular destroyed, so that an improper use can be detected in a simple manner. Likewise, the closing element may comprise a thermoplastic material or a polymer or may be made of a thermoplastic material or a polymer. In particular, the housing element and the closing element may comprise identical materials or may be made of identical materials.

Preferably, the aforementioned polymer is a thermoplastic polymer, which shrinks, i.e. contracts, during cooling and/or hardening.

The connector has a front end and a rear end. The front end of the connector is preferably the end of the connector with which the connection with the complementary connector is established. Preferably, the connector contacts the complementary connector at the front end during connection.

The rear end is arranged opposite to the front end. At the rear end, the electrical cable is routed out of the connector. Thus, a cable end area is arranged on or in the connector. The further cable end area may be connected with or be arranged on or in a different component, for example a solar junction box, an energy pick-up, etc.

The term "locked" or "lockable" describes that it is advantageously not possible for the connector to unlock from the complementary connector locked therewith by action of force, provided the acting force is so small that no damage or destruction of the connector or the complementary connector occurs. For practical purposes, the locking takes place due to a clear displacement movement, and is preferably accompanied by a corresponding locking noise, so that a flawless locking can be ascertained during assembly. Thus, the assembly of the connector with the complementary connector can be performed in a fast and precise manner. Assembly errors and/or bad contactings can be avoided. The term "locked" and the term "fixed" may be used synonymously. Likewise, the term "lockable" and the term "fixable" can be used synonymously.

The term "substantially" may describe a slight deviation from a target value, in particular a deviation within the production accuracy and/or within the necessary accuracy, so that an effect as present with the target value is maintained. Thus, the term "substantially" may describe a deviation from a target value or target position, etc., of less than approx. 30%, less than approx. 20%, less than approx. 10%, less than approx. 5%, less than approx. 2%, preferably less than approx. 1%. The term "substantially" comprises the term "identical", i.e. without a deviation from a target value, a target position, etc.

Preferred Embodiments of the Connector System

Preferably, the locking device and the complementary locking device are arranged and designed such that the locking device and the complementary locking device are displaceable relative to each other along an unlocking direction for unlocking, wherein the unlocking direction is substantially perpendicular to the insertion direction, and when the connector and the complementary connector are locked with each other, the locking device surrounds or circumferences the complementary locking device such that an unlocking opening is formed, through which a tool for unlocking is insertable into the locking device and/or the complementary locking device along a tool insertion direction, and the locking device and the complementary locking device are displaceable relative to each other along the unlocking direction by means of the tool.

Preferably, the tool insertion direction is substantially perpendicular to the insertion direction and substantially perpendicular to the unlocking direction.

Preferably, when the connector and the complementary connector are locked with each other, the locking device surrounds the complementary locking device such that the locking device is closed along the unlocking direction.

It is also possible that when the connector and the complementary connector are locked with each other, the complementary locking device surrounds the locking device such that the complementary locking device is closed along the unlocking direction.

Preferably, the tool insertion direction is substantially perpendicular to the insertion direction and substantially parallel to the unlocking direction.

Preferably, the closing element arranged on the housing element is more flexible than the housing element. Further preferably, the closing element arranged on the complementary housing element is more flexible than the complementary housing element.

Advantageously, due to the flexibility of the respective closing element, the connectors and the complementary connectors are very insusceptible to external actions of force. For example, the cable exiting the rear end of the connector/complementary connector may be moved, in particular may be bent, wherein the flexible closing element can adapt to the movement and does in particular not split or break due to the movement. Particularly advantageously, entrance of moisture through the rear end of the connector/complementary connector is substantially prevented also in case of a movement of the cable.

In other words, the closing element may be "flexible", i.e. in particular have a different elasticity modulus than the housing element, which may be "rigid". In particular, the elasticity modulus of the housing element is greater than the elasticity modulus of the closing element. For example, the elasticity modulus of the closing element is approx. 3 MPa and the elasticity modulus of the housing element is approx. 1000 MPa. Advantageously, it is thereby achieved that the closing element adapts to the shape of the housing element as exactly as possible, on the one hand. To this end, for example, the closing element may be softer than the housing element and/or more resilient. On the other hand, advantageously, a moisture-tight, in particular water-tight, sheathing of the rear end of the housing element and the cable can be allowed thereby. The closing element may contact, in particular surround or embrace or sheathe, the housing element and/or the cable. The term "flexible" may comprise plastic and/or elastic deformability and/or resilience.

The terms "flexible" and "rigid" as defined by the application are understood to mean the following mechanical material properties, which may substantially be quantified by the elasticity modulus E and the shear modulus G. Both a flexible and a rigid material may substantially be elastically and plastically deformable. An elastic deformation is understood to be the geometric deformation of a resilient body by an acting force or mechanical stress (force per area), which is substantially fully reversible if the force or mechanical stress does not act on the body any more, so that the body returns to its original shape. In contrast to a body that is rigid relative thereto, or short rigid body, a flexible body distinguishes itself in that the elasticity modulus $E_f$ and/or the shear modulus $G_f$ of the flexible body, e.g. of the closing element, are smaller than the elasticity modulus $E_s$ and/or the shear modulus $G_s$ of the rigid body, e.g. of the housing element. In other words, upon application of a force or mechanical stress of the same magnitude, a flexible body (e.g. the closing element) is geometrically deformed more strongly than a rigid body (e.g. the housing element).

Further preferably, the ratio $E_s/E_f$ and/or $G_s/G_f$ is greater than approx. 1.5, particularly preferably greater than approx. 2 or greater than approx. 5, or greater than approx. 10, in particular greater than approx. 50 or greater than approx. 100. Preferably, the shear modulus $G_f$ of e.g. the closing element is less than $10^9 N/m^2$, further preferably less than $10^8 N/m^2$, particularly preferably less than $10^7 N/m^2$, and particularly less than $5\times10^6 N/m^2$. Preferably, the shear modulus $G_s$ of e.g. the housing element is greater than $5\times10^6 N/m^2$, further preferably greater than $10^7 N/m^2$ or greater than $10^8 N/m^2$, particularly preferably greater than $10^9 N/m^2$, and in particular greater than $5\times10^9 N/m^2$.

The housing element and/or the complementary housing element may in some area(s) e.g. be made of polyamide, in particular polyamide 66 (PA66) or fiberglass-reinforced polyamide with an elasticity modulus of approx. 1 GPa to approx. 11 GPa, in particular approx. 3 GPa or approx. 10 GPa. The melting temperature of the material of the housing element, in particular of the polyamides, may be approx. 250° C. to approx. 265° C.

The closing element preferably consists at least in some area(s) or fully of a thermoplastic elastomer (TPE) or a thermoplastic vulcanizate (TPV) with an elasticity modulus of approx. 2 MPa to approx. 10 MPa, in particular approx. 3 MPa or approx. 4 MPa. Further preferably, the closing element is made of a polyolefine. Particularly preferably, the closing element is made of an α-vinyl copolymer, in particular an ethylene propylene copolymer. The temperature range in which the thermoplastic elastomers are plastically deformable or can melt preferably lies below the melting temperature of the material of the housing element (i.e. in particular of polyamides). In particular, the temperature range is approx. 170° C. to approx. 250° C. Surprisingly, from the preferred choice of material, there advantageously results a connection between the housing element and the flexible sealing element and/or between the complementary housing element and the flexible sealing element, which exhibits specially good adhesive and sealing properties, so that the connector system is protected from moisture or water vapor particularly well. In particular, due to the preferred choice of material, the close connection between the housing element and the sealing element and/or between the complementary housing element and the sealing element is advantageously achievable, so that at the rear end, the interior of the housing element and/or the interior of the complementary housing element is sealed from the surrounding in a substantially fully moisture-tight manner.

Preferably, the flexible closing element is made of a material that is shrinkable.

The term "shrinkable" as used in this application describes a change of volume, in particular a reduction of volume, of between approx. 0.1% and 5%, preferably between approx. 0.2% and approx. 2%, particularly preferably between approx. 0.3% and approx. 0.7%.

The term "close" as used in this application may thus in particular describe that the interior of the closing element is slightly larger than the exterior of the housing element upon mounting on the housing element. Preferably, the interior of the closing element has substantially the same size as the exterior of the housing element upon mounting on the housing element. However, the closing elements changes its interior size or its interior dimension or its volume extension. In particular, the closing element shrinks at least in the interior or the material contracts/compresses, wherein the external dimension of the housing element counteracts a reduction of the interior of the closing element. Thus, a tension arises between the closing element and the housing element. This tension can create or define the close connection. The tension of the close connection can create the moisture-tight connection of the closing element with the housing element. The tension or close connection can allow the closing element to be fixedly arranged on the housing element. Likewise, a close connection with the electrical cable can be establishable.

In other words, the "close connection" can be performed by shrinking a surrounding or circumferencing body on another surrounding or circumferencing body, so that the surrounding body in the contact area applies a force or mechanical stress to the surrounding body, so that by an elastic or plastic deformation of the two bodies in the contact area, substantially no gap exists between the two bodies. In particular, the two bodies may be molten or fused together in the contact area. This does not conflict with the fact that a sufficiently small gap may exist between the two bodies, preferably, the distance between the two bodies in the contact area is less than approx. 10 μm, particularly preferably less than 5 μm, and in particular less than 2 μm.

The shrinking of the closing element may be achieved e.g. by heating the closing element. The shrinking may also be achieved by arranging the closing element on the housing element in a viscous/liquid and/or crosslinked form and by solidifying and/or being crosslinked substantially completely. Even if the closing element is substantially completely solidified, it remains flexible. The term "substantially completely solidified" as defined by the invention thus describes that the closing element substantially maintains its shape, except for possible changes due to an external action of force.

Preferably, the flexible closing element is made of a material that can be shrunk more strongly than the material of the housing element and/or that can be shrunk more strongly than the material of the cable end area of the cable.

Preferably, the flexible closing element is applied to the housing element and the area of the electrical cable arranged outside the housing element in a substantially liquid form, and the close connection is established by cooling and/or hardening of the flexible closing element.

In other words, the material of the closing element shrinks during cooling, wherein the material of the closing element cools down below a liquefaction temperature. The material of the (liquid) closing element can also heat the material of the housing element, so that the material of the housing element can shrink during cooling as well. It is a property of the material of the closing element that, during cooling to a common temperature, it shrinks more strongly than the material of the housing element and/or the cable.

Thus, it can advantageously be achieved that the closing element is closely connected with the housing element and the cable. Here, the housing element and/or the cable is/are formed and arranged such that the liquid closing element can enter the housing element or enter openings of the housing element at least in some area(s) and, and after solidification of the closing element, thus the housing element and the closing element are preferably inseparable or the closing element and/or the housing element are at least partially non-reversibly destroyed upon separating the closing element from the housing element. Further preferably, one or more projections of the closing element are formed, which engage in or with one or more recesses and/or openings of the housing element.

Preferably, the flexible closing element, the housing element and the electrical cable are formed such that the substantially liquid, flexible closing element melts or fuses together with the housing element at least partially and that the substantially liquid, flexible closing element is connected with the electrical cable substantially exclusively in a mechanical manner.

The closing element may melt or fuse together with the housing element up to a depth of approx. 0.1 mm, in particular form a chemical compound that is particularly not separable any more or wherein upon separation at least up to the aforementioned depth, the housing element is destroyed and/or the closing element is at least destroyed, in particular torn laminary.

Preferably, the electrical cable comprises a sheath of a polymer material, wherein the polymer material of the sheath of the cable is crosslinked in particular completely, but at least in an end area of the cable, preferably by beta radiation.

Preferably, at least or exactly in the area of the cable surrounded by the flexible closing element, the polymer material of the sheath of the cable is crosslinked in particular by beta radiation. Advantageously, a moisture-tight connection between the flexible closing element and the sheath of the cable is made possible as well, although the sheath of the cable is passivated in relation to a chemical compound.

It was found that, surprisingly, also in the case of a cable crosslinked by beta radiation, such a close connection between the flexible closing element and the cable end area and also between the flexible closing element and the housing element can be established by shrinking the flexible closing element so that the rear end of the connector is moisture-tight according to IP 67 and particularly preferably also according to IP 68.

Preferably,

- the complementary electrical contact element is at least in some area(s) arranged in the insertion device of the complementary connector,
- the electrical contact element of the connector is at least in some area(s) arranged in the receiving device of the connector, wherein
- when the connector and the complementary connector are locked together,
  - the contact element contacts the complementary contact element within the insertion device and within the receiving device, and
  - a sealing element, in particular an O ring, is arranged between the insertion device and the receiving device such that the electrical contact element and the complementary electrical contact element are sealed from the surrounding in a substantially moisture-tight manner.

Use According to One Aspect

One aspect of the present invention relates to a use of a connector and of a complementary connector for provision in a connector system according to the invention.

Use According to One Aspect

One aspect of the present invention relates to a use of an inventive connector system for connecting a solar or photovoltaic module with a power or energy pick-up.

Preferably, during use of the connector system for connection with a solar module, the solar module is arranged on a face or surface, for example a roof, and the connector system is arranged between the solar module and the surface. This is advantageously possible due to the low construction height of the connector system, and thus further advantageously, the connector system is also protected against bad weather conditions, in particular rain and/or snow and/or external force influences caused by strong winds and/or inadvertent operation, e.g. by children.

Method According to One Aspect

One aspect of the present invention relates to a method for manufacturing a connector, with the steps:

- providing a housing element,
- providing an electrical cable,
- arranging the cable at least in some area(s) in the housing element, and electrically contacting the electrical conductor of the cable with an electrical contact element of the connector, and arranging a closing element on the housing element and on a cable end area of the cable by applying the substantially liquid material of the closing element to the housing element and the cable end area of the cable and by cooling and/or hardening of the substantially liquid material of the closing element, wherein the closing element substantially solidifies and shrinks and establishes a close connection with the housing element and the cable end area of the cable.

Basically, by analogy, the complementary connector can be manufactured, and so can the connector system by locking the connector with the complementary connector.

The preceding description of the aspects of the invention is not limited to the respective aspects. Instead, the explanations concerning the respective aspects analogously apply to further aspects of the invention. In particular, the explanations concerning the connector also apply to the complementary connector and vice versa, as well as to the use and the method and preferred embodiments or variants thereof.

DESCRIPTION OF FIGURES

Preferred embodiments of the present invention will exemplarily be described in the following on the basis of accompanying drawings. Individual elements of the described embodiments are not limited to the respective embodiment. Instead, elements of the embodiments can be arbitrarily combined and new embodiments can be obtained thereby. The figures show:

FIG. 1 shows an exploded view of a connector system 1. The connector system 1 comprises a connector 10 and a complementary connector 12. The connector 10 and the complementary connector 12 are also illustrated in an exploded view. The electrical cables (shown in FIG. 2), which are connected with the connector 10 and the complementary connector 12, are not shown in FIG. 1. The thickness of the connector system 1 is preferably approx. 8 to approx. 15 mm, in particular approx. 12 mm. The connector 10 and/or the complementary connector 12 may e.g. be of polyamide, in particular fiberglass-reinforced polyamide with an elasticity modulus of approx. 1000 MPa to approx. 11000 MPa, in particular approx. 3000 MPa or approx. 10000 MPa. The melting temperature of the polyamides may be approx. 250° C. to approx. 265° C. In some area(s), the connector 10 and the complementary connector 12 may consist of thermoplastic elastomers with an elasticity modulus of approx. 2 MPa to approx. 10 MPa, in particular approx. 3 MPa or approx. 4 MPa. The temperature range in which the thermoplastic elastomers are plastically deformable may be approx. 170° C. to approx. 250° C.

The connector 10 comprises a housing element 14 and a closing element 16. Furthermore, FIG. 1 shows an electrical contact element 18 of the connector 10, which is arranged in the receiving device 20 in the operative use of the connector 10. Moreover, FIG. 1 shows a locking device 22. The locking device 22 comprises two latching elements 24*a*, 24*b*, which are arranged on the housing element 14 of the connector 10. Each of the latching elements 24*a*, 24*b* has an insertion opening 26*a*, 26*b* as well as a tool insertion opening 28*a*, 28*b* as the preferred unlocking openings. In addition, each latching element 24*a*, 24*b* has a covering element 30*a*, 30*b*. In a locked state, the respective covering element 30*a*, 30*b* prevents a manual actuation of complementary latching elements 32*a*, 32*b* of a complementary locking device 34, which are arranged on a complementary housing element 35 of the complementary connector 12.

Figure 1:
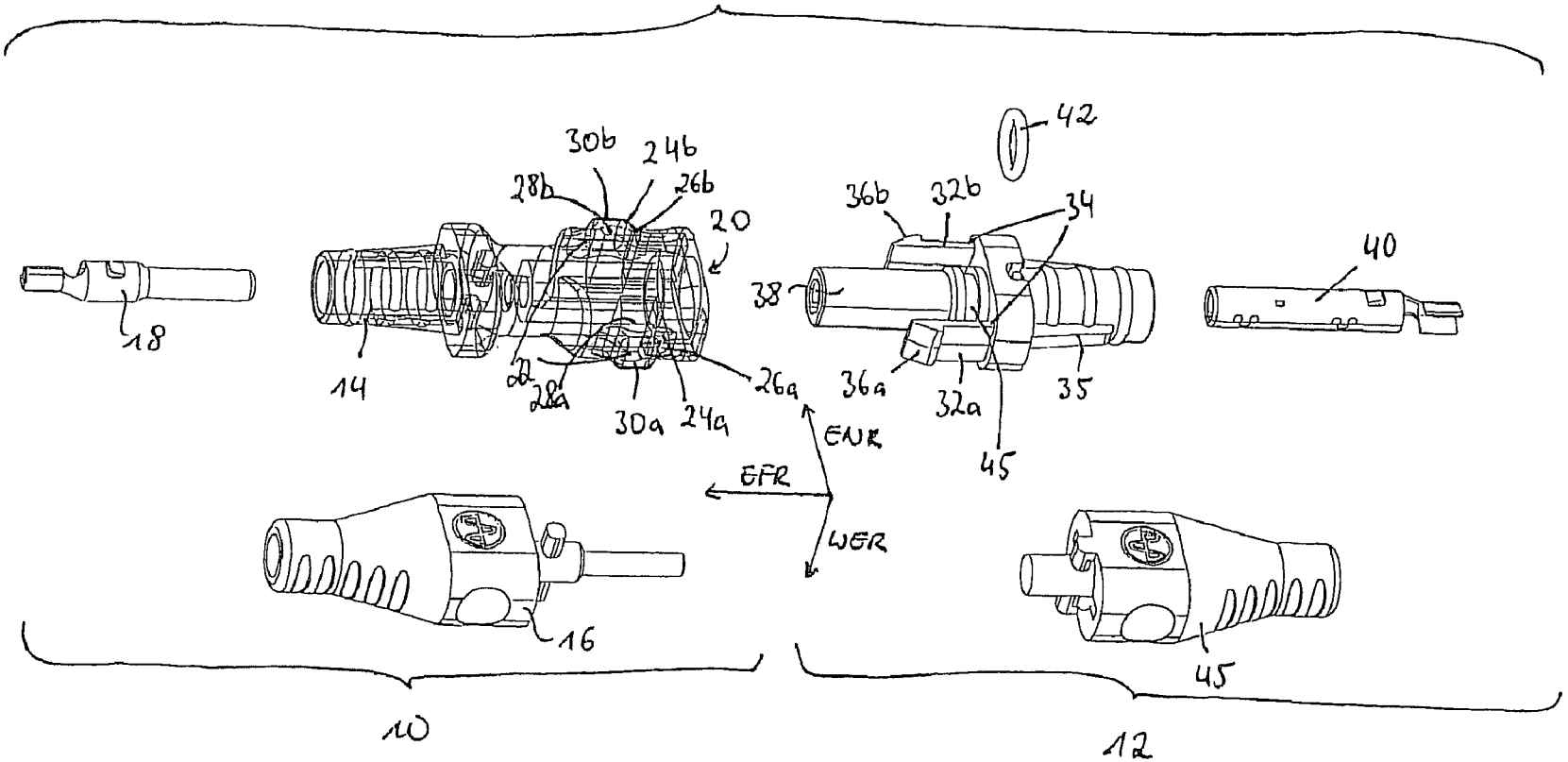
FIG. 1: an exploded view of a connector system.

The tool insertion openings 28*a*, 28*b* are preferably dimensioned such that a toolless actuation is prevented. In particular, the tool insertion openings 28*a*, 28*b* are preferably dimensioned such that a finger cannot be inserted.

For example, when the connector 10 is locked with the complementary connector 12, the latching elements 32*a*, 32*b* can be respectively inserted into the latching elements 24*a*, 24*b* of the locking device 22 of the connector 10. In doing so, the connector 10 and the complementary connector 12 are moved relative to each other along or against an insertion direction EFR. The complementary latching elements 32*a*, 32*b* pass through the insertion openings 26*a*, 26*b* at least in some area(s), wherein due to the inclined faces 36*a*, 36*b* and the arrangement or extension of the insertion openings 26*a*, 26*b*, the latching element 32*a* is moved along an unlocking direction ENR, and the latching element 32*b* is moved against the unlocking direction ENR. In the completely locked state, due to the extension of the tool insertion opening 28*a*, 28*b* and due to the resilience of the complementary latching elements 32*a*, 32*b*, the complementary latching element 32*a* can at least partially regain its original displacement against the unlocking direction ENR. This applies analogously to the complementary latching element 32*b*. Thereby, the latching elements 24*a*, 24*b* are locked with the respective complementary latching element 32*a*, 32*b*, and thus also the locking device 22 with the complementary locking device 34.

At the same time, an insertion device 38 is inserted into the receiving device 20 along the insertion direction EFR. In the operative use, the insertion device 38 includes a complementary electrical contact element 40 of the complementary connector 12. When the insertion device 38 of the complementary connector 12 is inserted into the receiving device 20 of the connector 10, the electrical contact elements 18, 40 contact each other, wherein a pin of the electrical contact element 18 enters an opening of the complementary electrical contact element 40.

Moreover, FIG. 1 shows an O ring 42 as the preferred sealing element, and a groove 44 for receiving the O ring. In the operative use of the connector system 1, when the connector 10 and the complementary connector 12 are locked, the O ring 42 contacts both the insertion device 38 (namely by arrangement of the O ring 42 in the groove 44) and the receiving device 20, since the inner diameter of the receiving device 20 substantially corresponds to the outer diameter of the insertion device 38, or is slightly larger. Thus, the O ring 42 is squeezed and establishes a moisture-tight connection between the connector 10 and the complementary connector 12, so that in particular no moisture can reach the electrical contact elements 18, 40 from outside through the gap between the insertion device 38 and the receiving device 20. Furthermore, the connector 10 is sealed or closed by means of the closing element 16 in a moisture-tight manner, and the complementary connector 12 by means of the closing element 45.

For unlocking, a tool (not shown) can be inserted into the tool insertion openings 28*a*, 28*b* along a tool insertion direction WER. By means of the tool, the complementary latching element can be displaced in the unlocking direction ENR, and the locking between the latching element 24*a* and the complementary latching element 32*a* can be released. Analogously, the complementary latching element 32*b* can be displaced against the unlocking direction ENR, and the locking between the latching element 24*b* and the complementary latching element 32*b* can thus be released. Now, if the complementary connector 12 is moved against the insertion direction EFR, the connector 10 and the complementary connector 12 can be separated from each other.

A tool may e.g. be a screw driver, pliers, a nail, a tool matched to the locking devices 22, 34, etc.

The covering elements 30*a*, 30*b* serve to protect the locking devices 22, 34 from an inadvertent operation. In particular, it is not possible to unlock the locking devices 22, 34 manually, i.e. without a tool, e.g. only with someone's fingers. On the one hand, the tool insertion openings are arranged and dimensioned such that only a tool can be inserted, and limbs, in particular a finger, cannot be inserted. Furthermore, the locking elements 24*a*, 24*b* cannot be compressed in a simple way to release a locking, and a manual displacement of the complementary latching elements 32*a*, 32*b* is prevented by the covering elements 30*a*, 30*b*.

The "insertion direction" EFR as defined by the present invention is e.g. a direction in which the insertion device 38 is inserted or insertable into the receiving device 20. For example, the insertion direction may be parallel to a longitudinal axis of the connector 10 and/or of the complementary connector 12 when the connector system 1 is locked.

The insertion direction EFR, the tool insertion direction WER and the unlocking direction ENR preferably form an orthogonal coordinate system.

Figure 2:
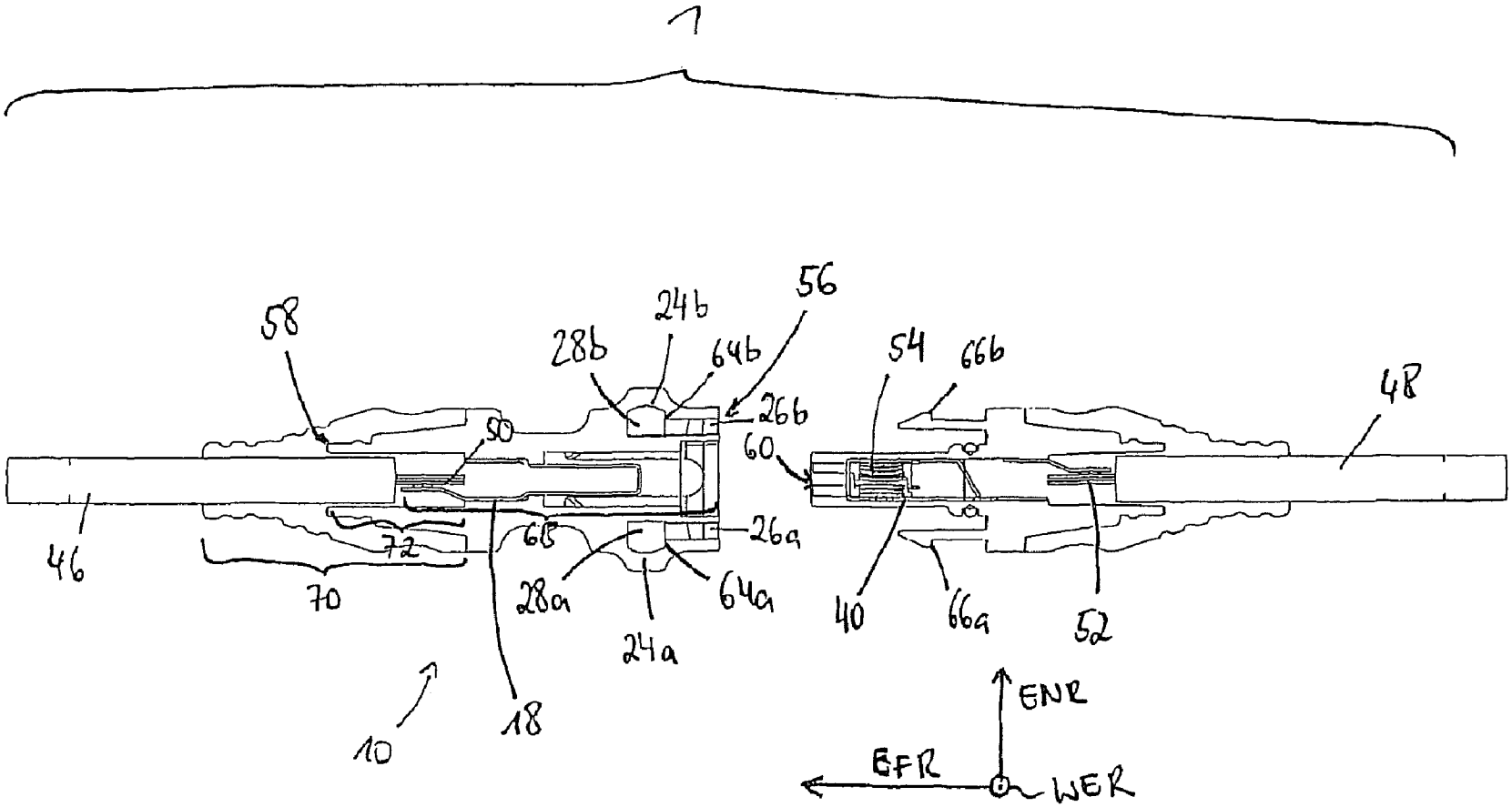
FIG. 2: a sectional view of an unlocked connector system.

FIG. 2 shows a sectional view of a connector system 1 in an unlocked state. In particular, a cable 46 is arranged on the connector 10. Likewise, a cable 48 is arranged on the complementary connector 12. A conductor 50 of the cable 46 is connected with the electrical contact element 18 in an electrically conducting manner, and the contact element 18 is further fixed to the cable 46 in a mechanical manner. Likewise, an electrical conductor 52 of the cable 48 is connected with the electrical contact element 40 in an electrically conducting manner, and the contact element 40 is further fixed to the cable 48 in a mechanical manner.

The electrical contact elements 18, 40 preferably are so-called punched contacts, i.e. the electrical contact elements 18, 40 may be punched out of a flat metal sheet of a conductive material and be bent into the desired shape afterwards. Thus, the contact elements 18, 40 can be fabricated in a simple and reliable, in particular cost-efficient, manner.

Furthermore, FIG. 2 shows a substantially cylinder-shaped contact bush 54 also produced from a punched metal sheet. The contact bush 54 further has longitudinal slits, wherein the diameter is tapered toward the center of the contact bush. Thus, the contact bush 54 obtains resilient properties, whereby a secure electrical contact between the contact bush 54 of the complementary contact element 40 and the contact element 18, which is pushed into the complementary contact element 40 and in particular into the contact bush 54, is guaranteed.

Moreover, FIG. 2 shows a front end 56 of the housing element 14 and a rear end 58 of the housing element 14. Also, an end 60 of the complementary housing element 35 and a rear end 62 of the complementary housing element 35 are illustrated. The cable 46 exits the rear end 58 of the housing element 14. The closing element 16 surrounds or circumferences both an area of the cable 46 and an area of the housing element 14, in particular the rear end 58 of the housing element 14. By shrinking the closing element 16 both on the cable 46 and on the housing element 14, entrance of moisture into the interior of the connector 10, in particular into the electrical contact element 18, through the rear end of the housing element 14 is prevented, on the one hand. On the other hand, at the same time, the mechanical connection of the cable 46 and the housing element 14 is reinforced, wherein the flexible closing element 16 is capable of compensating for movements of the cable 46 without it being damaged and without moisture being allowed to enter.

Furthermore, FIG. 2 illustrates the locking device 22 with the latching elements 24*a*, 24*b*. In particular, FIG. 1 shows edges 64*a*, 64*b* with which the complementary latching elements 32*a*, 32*b*, in particular the edges 66*a*, 66*b* thereof, can come into engagement and form a form fit in a locked state. The latching elements 32*a*, 32*b* can be inserted into the locking device 22 through the insertion openings 26*a*, 26*b*.

Moreover, the tool insertion direction WER is shown, along which a tool (not shown) is insertable into the tool insertion opening 28*a*, 28*b*. Also, FIG. 2 shows the unlocking direction ENR.

Furthermore, FIG. 2 shows an area 68 of the front end 56 of the housing element 14. Starting from the front end 56, the area 68 has a length of approx. 42 mm. The area 68 is spaced from the rear end 56 of the connector approx. 42 mm. Also, FIG. 2 illustrates an end area 70 (approx. 35 mm long) of the cable 46. The end area 70 is at least partially surrounded, or circumferenced, or contacted by the flexible closing element 16. A subarea 72 (approx. 18.6 mm long) of the cable end area is arranged within the housing element 14. At least in the cable end area 70, the cable sheath, as far as still present, is crosslinked by beta radiation.

The above explanations analogously apply to the illustrated complementary connector 12 as well.

Figure 3:
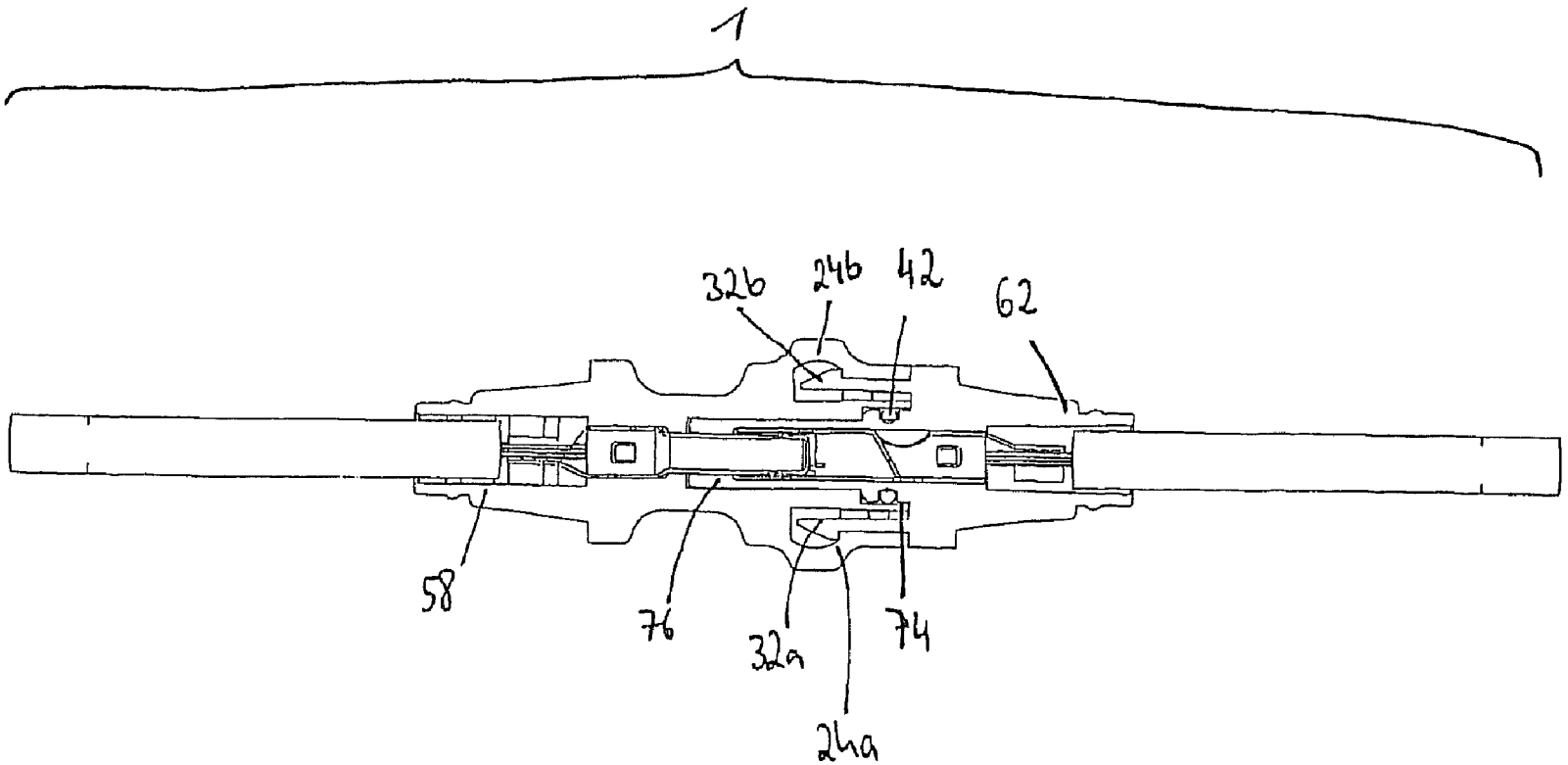
FIG. 3: a sectional view of a locked connector system.

FIG. 3 shows a sectional view similar to FIG. 2, wherein the connector system 1 is locked, wherein identical reference numerals designate identical elements like in the preceding figures.

In particular, FIG. 3 shows the latching elements 24*a*, 24*b* and 32*a*, 32*b* in a locked state. Also, FIG. 3 shows the O ring 42 closing a gap 74, so that no moisture gets into the interior 76 of the locked connector system 1 from the front ends 56, 60 of the connectors 10, 12, i.e. no moisture gets to the electrical contact elements 18, 40. The rear ends 58, 62 are closed in a moisture-tight manner by means of the closing elements 16, 45.

LIST OF REFERENCE NUMERALS

1 connector system
10 connector
12 complementary connector
14 housing element
16 closing element
18 electrical contact element
20 receiving device
22 locking device
24*a* latching element
24*b* latching element
26*a* insertion opening
26*b* insertion opening
28*a* tool insertion opening
28*b* tool insertion opening
30*a* covering element
30*b* covering element
32*a* complementary latching element
32*b* complementary latching element
34 complementary locking device
35 complementary housing element
36*a* inclined face
36*b* inclined face
38 insertion device
40 complementary electrical contact element
42 O ring

44 groove
45 closing element
46 cable
48 cable
50 conductor
52 conductor
54 contact bush
56 front end of the housing element
58 rear end of the housing element
60 front end of the complementary housing element
62 rear end of the complementary housing element
64*a* edge
64*b* edge
66*a* edge
66*b* edge
68 area
70 area
72 subarea
74 gap
76 interior of the connector system
EFR insertion direction
ENR unlocking direction
WER tool insertion direction

The invention claimed is:

1. A connector system with a connector and a complementary connector, wherein the connector comprises:

a housing element with at least one locking device and at least one electrical contact element, wherein the at least one electrical contact element is arranged in the area of a front end of the housing element, an electrical cable, wherein a cable end area of the electrical cable is arranged in the area of a rear end of the housing element, and at least one conductor of the electrical cable is connected with the electrical contact element, and the cable extends toward the other cable end area through the rear end of the housing element out of the housing element, and a closing element arranged on the housing element, which closing element surrounds both at least the rear end of the housing element and an area of the electrical cable arranged outside the housing element, and is closely connected with the housing element and the electrical cable such that at the rear end, the interior of the housing element is sealed from the surrounding in a substantially fully moisture-tight manner, the complementary connector further comprises a complementary housing element with at least one complementary locking device and at least one complementary electrical contact element, wherein the at least one complementary electrical contact element is arranged in the area of a front end of the complementary housing element, comprises an electrical cable, wherein a cable end area of the electrical cable is arranged in the area of a rear end of the complementary housing element, and at least one conductor of the electrical cable is connected with the complementary electrical contact element, and the cable extends toward the other cable end area through the rear end of the complementary housing element out of the complementary housing element, and a closing element arranged on the complementary housing element, which closing element surrounds both at least the rear end of the complementary housing element and an area of the electrical cable arranged outside the complementary housing element, and is closely connected with the complementary housing element and the electrical cable such that at the rear end, the interior of the complementary housing element is sealed from the surrounding in a substantially fully moisture-tight manner, wherein the housing element further comprises receiving device at a front end, which is designed to receive an insertion device of the complementary connector arranged at the front end of the complementary connector at least in some area(s) along an insertion direction, and wherein the locking device and the complementary locking device are designed such that the at least one complementary locking device is at least in some area(s) insertable into the locking device along the insertion direction and can be locked with the locking device such that the locking device and the complementary locking device can be unlocked by actuation of the locking device and of the complementary locking device substantially exclusively by means of a tool, and to connect the insertion device of the complementary connector with the receiving device of the connector such that the electrical contact element is sealed from the surrounding in a substantially moisture-tight manner at the front end of the connector and the complementary electrical contact element is sealed from the surrounding in a substantially moisture-tight manner at the front end of the complementary connector.

2. The connector system according to claim 1, wherein the locking device and the complementary locking device are arranged and designed such that the locking device and the complementary locking device are displaceable relative to each other along an unlocking direction for unlocking, wherein the unlocking direction is substantially perpendicular to the insertion direction, and wherein when the connector and the complementary connector are locked with each other, the locking device surrounds the complementary locking device such that an unlocking opening is formed, through which a tool for unlocking is insertable into the locking device and the complementary locking device along a tool insertion direction (WER), and the locking device and the complementary locking device are displaceable relative to each other along the unlocking direction by means of the tool.

3. The connector system according to claim 2, wherein the tool insertion direction is substantially perpendicular to the insertion direction and substantially perpendicular to the unlocking direction.

4. The connector system according to claim 1, wherein when the connector and the complementary connector are locked with each other, the locking device surrounds the complementary locking device such that the locking device is closed along the unlocking direction.

5. The connector system according to claim 2, wherein the tool insertion direction is substantially perpendicular to the insertion direction and substantially parallel to the unlocking direction.

6. The connector system according to claim 1, wherein the closing element arranged on the housing element is more flexible than the housing element and wherein the closing element arranged on the complementary housing element is more flexible than the complementary housing element.

7. The connector system according to claim 1, wherein the closing element is made of a material that is shrinkable.

8. The connector system according to claim 7, wherein the closing element is made of a material that can be shrunk more strongly than the material of the housing element and, wherein the closing element is made of a material that can be shrunk more strongly than the material of the cable end area of the cable.

9. The connector system according to claim 1, wherein the closing element is applied to the housing element and the area of the electrical cable arranged outside the housing element in a substantially liquid form, and the close connection is established by cooling the closing element.

10. The connector system according to claim 9, wherein the closing element, the housing element and the electrical cable are formed such that the substantially liquid closing element melts together with the housing element at least partially and that the substantially liquid closing element is connected with the electrical cable substantially exclusively in a mechanical manner.

11. The connector system according to claim 1, wherein the electrical cable comprises a sheath of a polymer material, wherein the polymer material of the sheath of the cable is crosslinked at least in an end area of the cable by beta radiation.

12. The connector system according to claim 1, wherein the complementary electrical contact element is at least in some area(s) arranged in the insertion device of the complementary connector, the electrical contact element of the connector is at least in some area(s) arranged in the receiving device of the connector, and wherein when the connector and the complementary connector are locked with each other, the contact element contacts the complementary contact element within the insertion device and within the receiving device, and a sealing element, in particular an 0 ring, is arranged between the insertion device and the receiving device such that the electrical contact element and the complementary electrical contact element are sealed from the surrounding in a substantially moisture-tight manner.

13. A use of a connector and of a complementary connector for provision in a connector system according to claim 1.

14. A use of a connector system, according to claim 1, for connecting a solar module with a power pick-up.

* * * * *